US007183992B2

(12) United States Patent
Hung

(10) Patent No.: US 7,183,992 B2
(45) Date of Patent: Feb. 27, 2007

(54) ULTRA-WIDEBAND V-UHF ANTENNA

(75) Inventor: Frédéric Ngo Bui Hung, Franconville (FR)

(73) Assignee: Thales, Neuilly sur Seine (FR)

( * ) Notice: Subject to any disclaimer, the term of this patent is extended or adjusted under 35 U.S.C. 154(b) by 0 days.

(21) Appl. No.: 11/059,309

(22) Filed: Feb. 17, 2005

(65) Prior Publication Data

US 2005/0253768 A1 Nov. 17, 2005

(30) Foreign Application Priority Data

Feb. 27, 2004 (FR) ..... 04 02039

(51) Int. Cl.
*H01Q 9/04* (2006.01)

(52) U.S. Cl. ..... 343/790

(58) Field of Classification Search ..... 343/790, 343/791, 792, 793, 817, 818, 800
See application file for complete search history.

(56) References Cited

U.S. PATENT DOCUMENTS

| | | | | |
|---|---|---|---|---|
| 4,443,803 | A | 4/1984 | DeSantis et al. | 343/749 |
| 4,466,003 | A | 8/1984 | Royce | 343/826 |
| 4,734,703 | A | 3/1988 | Nakase et al. | |
| 4,958,164 | A | 9/1990 | Lewis, Jr. | 343/749 |
| 6,177,911 | B1 | 1/2001 | Yuda et al. | |
| 6,552,689 | B2 * | 4/2003 | Shinichi | 343/702 |
| 6,653,985 | B2 * | 11/2003 | Sikina et al. | 343/853 |
| 6,963,313 | B2 * | 11/2005 | Du | 343/790 |
| 2003/0227419 | A1 | 12/2003 | Hung | |
| 2005/0280584 | A1 * | 12/2005 | Aron et al. | 343/702 |

FOREIGN PATENT DOCUMENTS

| | | |
|---|---|---|
| DE | 3 826 777 | 2/1990 |
| EP | 1 286414 | 2/2003 |
| FR | 2 758 012 | 7/1998 |
| GB | 1 532 010 | 11/1978 |

* cited by examiner

*Primary Examiner*—Trinh Dinh
*Assistant Examiner*—Huedung Mancuso
(74) *Attorney, Agent, or Firm*—Lowe Hauptman & Berner, LLP

(57) ABSTRACT

A wideband antenna system is capable of radiating or receiving radio-frequency signals in a given frequency band, comprising at least two substantially collinear radiating elements, wherein each element radiates in one frequency band, a first radiating element working in the [Fhinf, Fhsup] frequency band, a second radiating element working in the [Fminf, Fmsup] frequency band. At the hinge frequencies, these two elements participate in the radiation.

8 Claims, 4 Drawing Sheets

ULTRA-WIDEBAND V-UHF ANTENNA

BACKGROUND OF THE INVENTION

1. Field of the Invention

The invention relates to an ultra-wideband antenna systems working both in sending or transmission mode and in reception mode without re-matching. It is designed for example for the frequencies band varying from 30 to 512 MHz, from the VHF (Very High Frequencies) up to the UHF (Ultra High Frequencies)

This band encompasses especially the classic bands: the usual VHF-FM or VHF frequency modulation band ranging from 30 to 88 MHz, the VHF-AM or VHF amplitude modulation band ranging from 100 to 160 MHz and the UHF-AM (UHF-amplitude modulation) band ranging from 225 to 400 MHz.

2. Description of the Prior Art

Modern transmission-reception (T/R) stations are capable of working in all the frequency bands varying from 30 to 512 MHz. However, the existing antenna systems that are associated with them, especially those designed to be installed in mobile telephones, provide optimum operation only in the active frequency bands, for example the VHF-FM (30–88 MHz) band or the VHF-AM (100–160 MHz) band or again the UHF-AM (225–400 MHz) band. Consequently, the exploitation of these transceivers necessitates the implementation of several antennas and a switching device to select the most suited antenna.

Ultra-wideband antenna systems enabling the discontinuity-free coverage of the entire 30 to 512 MHz band already exist for other systems using radio-frequencies, for example radiocommunications air-borne antenna systems, antenna systems for listening and scrambling in electronic warfare etc. However, these antennas have drawbacks which make them unsuited for use in a land-based moving object. Indeed, their efficiency is either too low for the radio range required for ground-ground links, as in the case of air-borne antennas, or their space requirement is incompatible with the dimensions of the vehicle.

There are numerous antenna structures covering a band of frequencies attaining the decade and having low space requirement. For example the patents U.S. Pat. Nos. 4,443,803, 4,466,003 or 4,958,164 describe such structures. However, the structures are all based on the contribution of resistive elements to the artificially widening of the antenna bandwidth. Consequently, a large part of the radio-frequency (RF) power is not radiated by the antenna but converted into heat within it. The efficiency of these types of antenna therefore proves to be very low. Another fault of the radiating structures described in the above-mentioned patents is their poor radiation pattern for the high frequencies.

The patents DE 3 826 777 or FR 2 758 012 propose structures known as multiband structures, that cover several frequency bands and do not have the above-stated defects. However, the frequency bands covered by these types of antenna must imperatively be discontinuous.

SUMMARY OF THE INVENTION

The idea of the present invention consists in proposing a single antenna that is capable of discontinuity-free functioning in at least in the entire frequency band ranging from 30 to 512 MHz, namely more than one frequency decade, and having dimensions such that it can be installed in place of a classic VHF-FM radio communications antenna, namely a whip-shaped antenna, while at the same time having efficiency sufficient to ensure radioelectrical ranges at least equivalent to those of existing installations. A view of such an antenna is shown diagrammatically in FIG. 1. The whip has a height for example of about 3 m.

The invention relates to a wideband antenna system capable of radiating or receiving radio-frequency signals in a given frequency band, comprising at least two substantially collinear radiating elements. It is characterized in that each element radiates in one frequency band, a first radiating element working in the [Fhinf, Fhsup] frequency band, a second radiating element working in the [Fminf, Fmsup] frequency band, and in that, at the hinge frequencies, these two elements participate in the radiation.

The frequency Fmsup is for example greater than or equal to the frequency Fhinf.

The antenna may comprise a third radiating element working in the frequency band [Fbinf, Fbsup].

The frequency Fbsup is for example greater than or equal to the frequency Fminf, and the frequency Fmsup is for example greater than or equal to the frequency Fhinf.

The antenna according to the invention has especially the following advantages:

It shows gain greater than that of known antenna systems, having the same space requirement and covering the same frequency band.

It provides for a single wideband antenna giving discontinuity-free coverage of more than one decade, especially from 30 to 512 MHz, with an efficiency and a gain greater than that of known antennas having the same operating frequency band.

BRIEF DESCRIPTION OF THE DRAWINGS

Other features and advantages of the present invention shall appear more clearly from the following description of an exemplary embodiment along with the appended drawings, of which.

MORE DETAILED DESCRIPTION

Figure 1:
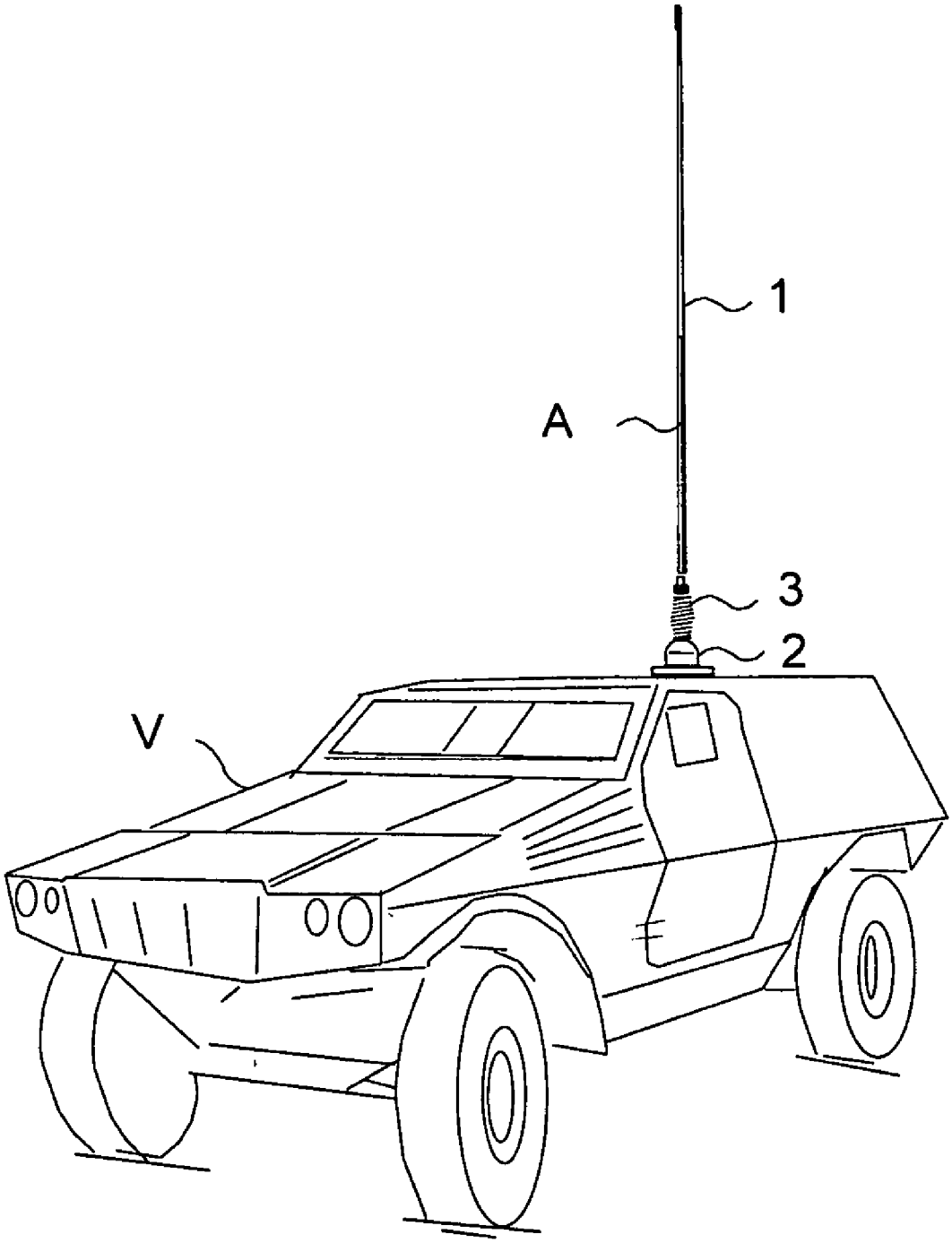
FIG. 1 is a drawing of an antenna according to the invention.

FIG. 1 exemplifies an antenna A installed in the vehicle V. This antenna is constituted for example by a radiating element 1 which takes the form of a whip and a base 2 used to fix the antenna to the carrier vehicle and usually comprising a power supply network to enable the maximum transfer of power from the transmitter/receiver to the radiating unit 1. In order to protect the antenna from accidental impact with obstacles, a flexible element 3 is interposed at its base. This flexible element, which is known to those skilled in the art, shall not be described in detail for the sake of simplification.

Figure 2:
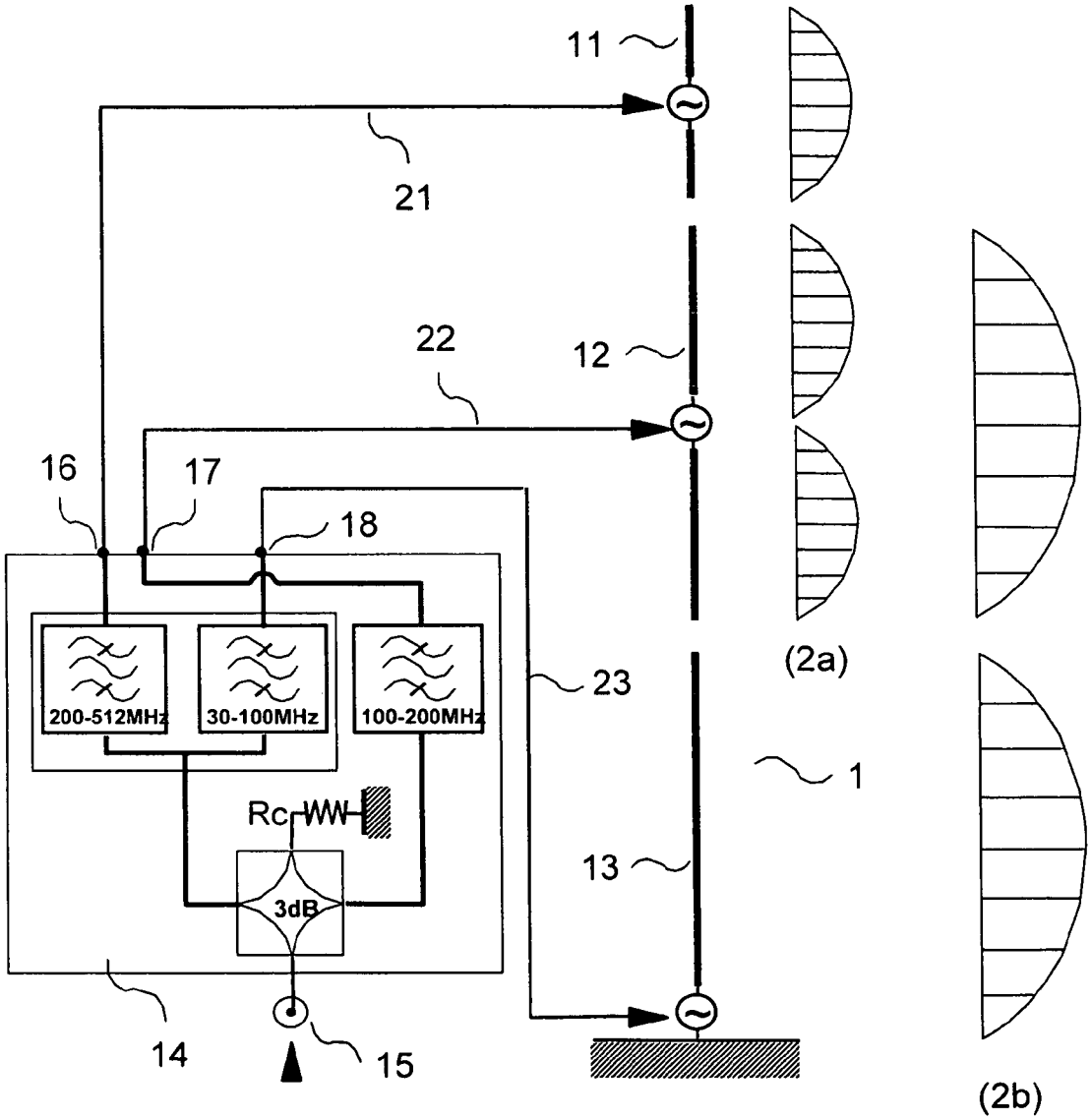
FIG. 2 comprises a block diagram and a drawing of the operating principle of such an antenna.

FIG. 2 shows a block diagram and the principle of operation of an antenna according to the invention, working in the 30 to 512 MHz band. The values of this band are given by way of illustration and in no way restrict the scope of the invention.

The antenna A comprises for example:

- a radiating assembly 1 constituted by two collinear dipoles 11 and 12 and one monopole 13, a power supply network 14 having one input 15 and three outputs 16, 17, 18 respectively connected to the dipoles 11, 12 and to the monopole 13 by three transmission lines 21, 22, 23 respectively.

The first dipole 11 placed at the summit of the radiating assembly 1 is designed to work in the upper part [Fhinf to Fhsup] of the useful band, which in this example ranges from 200 to 512 MHz. To make it easier to understand the invention, the matching circuit and the bandwidth widening methods, known to those skilled in the art, for matching this dipole in the 200 to 512 MHz band are not described in detail.

The second dipole 12 placed beneath the first dipole 11 covers the adjacent band [Fminf to Fmsup] from 100 to 200 MHz. For the same reason as above, its matching circuit is not described.

The monopole 13 located at the lower part of the antenna (below the other two) ensures operation in the 30 to 200 MHz bandwidth [Fbinf to Fbsup]. The choice of a monopole-type structure may be replaced by that of a dipole structure. The monopole can be used especially to obtain a more limited antenna size.

The power supply network 14 especially has a function of leading:

the signals Sbh of the high band [Fhinf to Fhsup] coming from the input 15 to the output 16 which powers the radiating element 11, the signals Sbm of the medium band [Fminf to Fmsup] coming from the input 15 to the output 17 which powers the radiating element 12, the signals Sbb from the low band [Fbinf to Fbsup] coming from the input 15 to the output 18 which powers the radiating element 13.

The size of each radiating element 11, 12 and 13 is, for example, sized in such a way that:

At the overlapping frequency Fhinf, chosen to be equal or substantially equal to Fmsup (for example, a frequency of 200 MHz) between the high band and the medium band, the dipoles 11 shows a half-wave type radiation while the dipoles 12 shows a full-wave type radiation that is in phase with that of the dipole 11. This phasing is obtain, for example, in the example given, by radioelectrically pairing the lengths of the transmission lines 21 and 22. The distribution of current on the radiating elements is shown in the drawing of FIG. 2*a*.

At the overlapping frequency Fminf chosen to be equal or substantially equal to Fbsup (for example, at the frequency of 100 MHz) between the medium band and the low band, the dipole 12 has a half-wave type radiation while the monopole 13 has a full-wave type radiation in phase with that of the dipole 12. This phasing is obtain in the example given by radioelectrically pairing the lengths of the transmission lines 22 and 23. The distribution of current on these radiating elements is represented in the drawing of FIG. 2*b*.

This disposition thus enables the radiating assembly 1 to work from the lowest frequency Fbinf (30 MHz in the example given) up to the highest frequency Fhsup (in this example 512 MHz) without the radiation being disturbed in the neighborhood of the hinge frequencies (Fhinf, Fmsup) and (Fminf, Fbsup), thus preventing the use of these frequencies as in the prior art antenna.

Figure 3A:
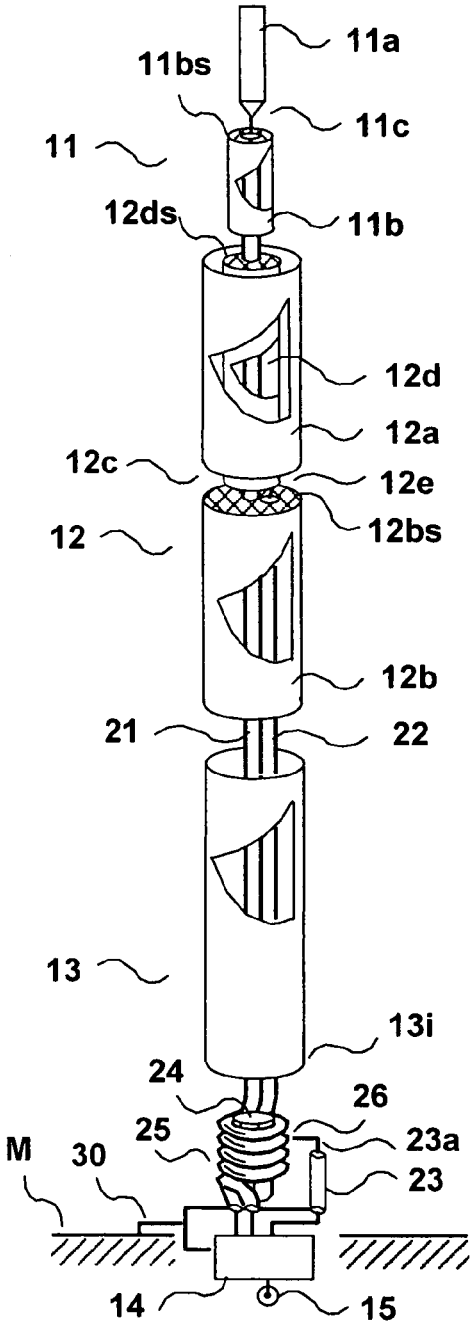
FIGS. 3*a* and 3*b* show a detailed exemplary embodiment of an antenna.
Figure 3B:
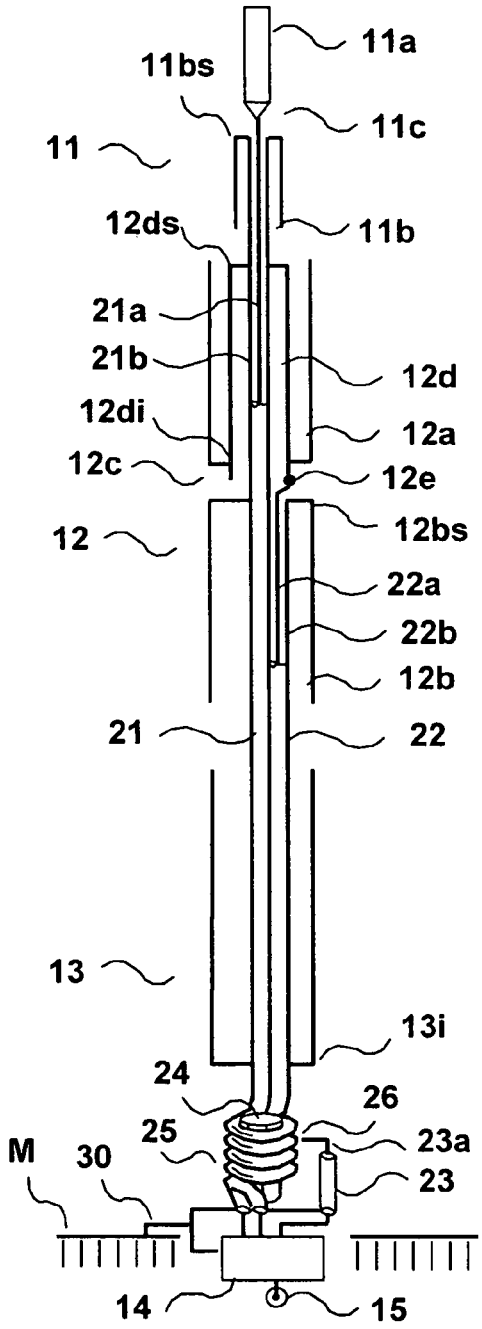

FIG. 3*a* shows an example of an embodiment of an antenna according to the invention and FIG. 3*b* shows a corresponding view in section. For a clearer view of the constitution of the antenna, openings have been deliberately cut out in FIG. 3*a* in certain elements comprising the antenna. In this example, the dipoles are skirt dipoles, the references 11, 12, 13 of FIG. 2 having been retained for reasons of simplicity.

The antenna has a first skirt dipole 11 located in its upper part, a second skirt dipole 12 collinear or substantially collinear with the first one and a monopole 13 placed at the lower part of the antenna.

The skirt dipole 11 is constituted by a first radiating element 11*a*, that can be made out of a tubular section and a second radiating element 11*b* made out of a hollow tubular section with a length substantially identical to the length of the element 11*a*, this hollow tubular section having the power supply cable 21 of the antenna threaded into it. These two radiating elements are powered at the point 11*c* in connecting the upper end of the core 21*a* (FIG. 3*b*) of the coaxial cable 21 to the base of the element 11*a* and connecting the sheathing 21*b* (FIG. 3*b*) of this cable 21 to the rim of the upper end 11*bs* of the element 11*b* to form what is commonly called a skirt. In order to optimize the working of the antenna, an impedance-matching quadripole, not shown for the sake of the clarity of the figure, may be interposed at the point 11*c*.

The length of the radiating elements 11*a* and 11*b* is, for example, in the range of a quarter of the wavelength of the hinge frequency Fhinf=Fmsup so that the dipole can radiate in half-waves at this frequency. For the example given, Fhinf=Fmsup=200 MHz and the theoretical length of the quarter wave in meters is given by the known relationship 300/4F (Mhz), giving 0.375 m in this example, where F is the frequency expressed in MHz. In order to take account of the edge effect known to those skilled in the art, a pitch factor of 0.8 is taking here, and the effective length of the elements 11*a* and 11*b* is 0.375*0.8=0.3 m.

The collinear skirt dipole 12 is for example formed by a counter-skirt or inverted skirt 12*a* and a skirt 12*b*, these two forming the two radiating elements of the dipoles. According to the invention, the length of the skirt is approximately twice that of the dipoles 11, namely in this example about 0.6 meters so that the dipoles radiate in the full-wave mode at the hinge frequency Fhinf=Fmsup. To radioelectrically insulate the counter-skirt 12*a* from the coaxial cable 21 that crosses it, a skirt 12*d* with the role of an insulation device commonly known as a "stub" is interposed between these two elements. The rim of the upper end 12*ds* of the skirt 12*d* is connected to the sheathing 21*b*, while its other end 12*di* is connected to the lower part of the counter-skirt 12*a*. This dipole is supplied at 12*c* in connecting the upper end of the core 22*a* of the power coaxial cable 22 to the lower edge of the insulation device or "stub" 12*d* at the point 12*e* and in connecting the sheathing 22*b* of this cable 22 and the sheathing 21*b* of the cable 21 to the rim of the upper end 12*bs* of the skirt 12*b*. As mentioned here above, it is possible to use an impedance-matching quadripole.

The monopole 13 takes the form, for example, of a counter-skirt. Its lower end 13*i* is connected at its rim to the sheathings 21*b* and 22*b* of the coaxial cable 21 and 22. According to the invention, the length of this counter-skirt is approximately twice that of the skirts of the dipole 12, namely about 1.2 m in this example, so that the monopole radiates in full-wave mode at the hinge frequency Fminf=Fbsup=100 MHz.

To radioelectrically insulate this monopole 13 from the ground plane M above which the antenna is installed, the cables 21 and 22 are wound about a core made of a known magnetic material 24, such as ferrite, powdered iron etc. This enables the constitution of a self-inductance coil 25 whose impedance is in the frequency band [Fbinf to Fbsup], namely an impedance appreciably greater than the impedance proper to the monopole 13 in the same frequency band. This monopole is powered by connecting the upper end of the core 23*a* of the cable 23 to one of the turns of the coil 25 at the specified point 26 to obtain the best impedance matching in the frequency band [Fbinf to Fbsup].

Usually, in order to improve the decoupling between the radiating elements 11, 12, 13, insulation devices playing the role of a self-inductance coil or choke, such as devices based on ferrite beads, rings or ferrite tubes are interposed between these elements.

Figure 4:
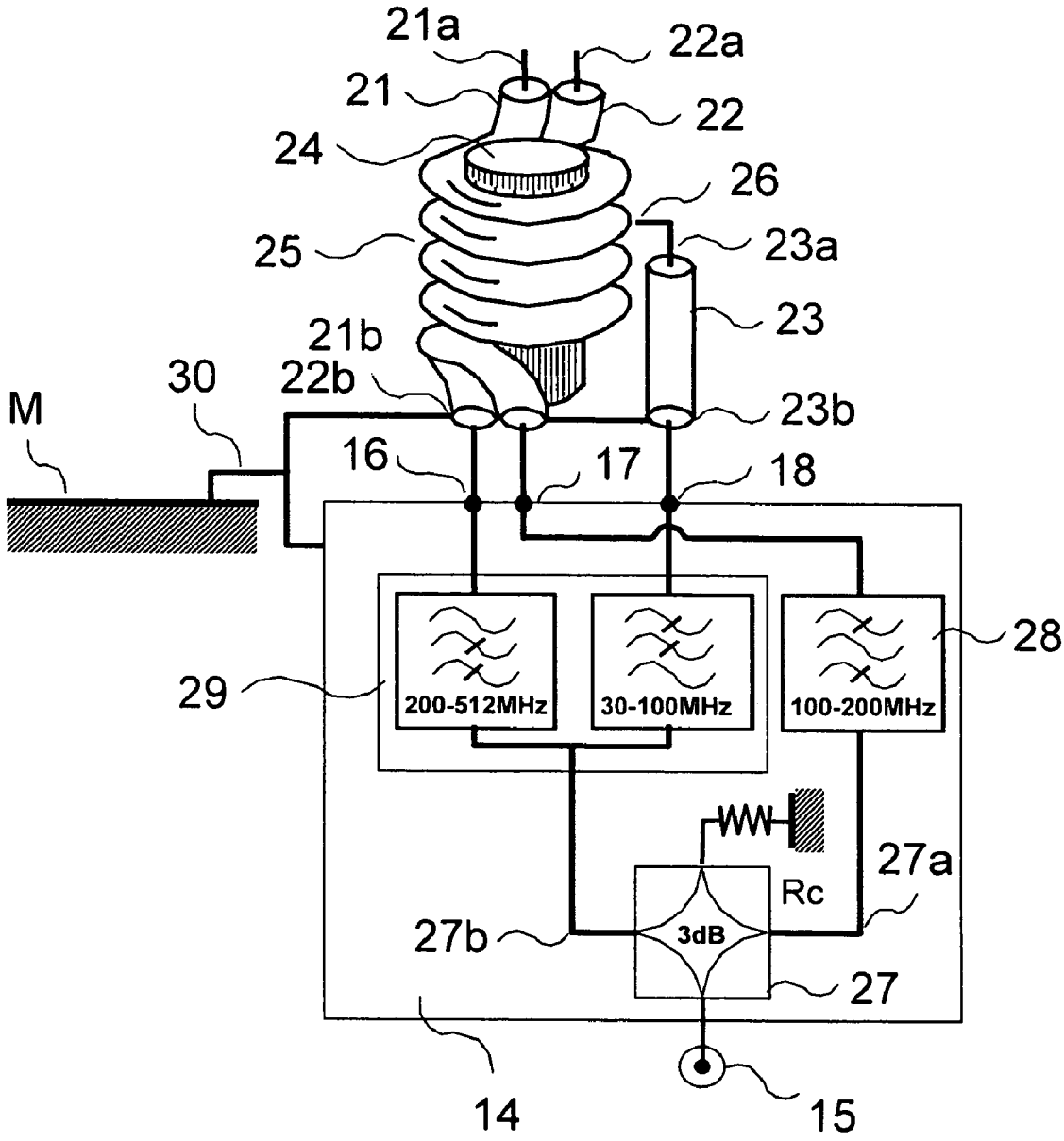
FIG. 4 shows a detailed view of an embodiment of the power supply device and its link with the antenna.

At the ground plane level M, the sheathing elements 21*b*, 22*b*, 23*b* and the ground of the power supply network 14, are connected to it by the connection assembly 30. The lower end of the coaxial cable cores 21, 22 and 23 are respectively connected to the outputs 16, 17 and 18 of the power supply network 14, an exemplary embodiment of which is described in the detail in FIG. 4. According to this figure, the radio-frequency signal coming from the input 15 is divided into two by a hybrid unit 27 toward the two channels 27*a* and 27*b*. The first channel 27*a* is filtered by a bandwidth filter [Fminf–Fmsup] 28, for the [100 MHz–200 MHz] exemplary embodiment and, after the filtering, constitutes the output 17. The other channel 27*b* is separated by the duplexer 29 into two sub-bands, one low sub-band [Fbinf–Fbsup], i.e. [30 MHz–100 MHz] for the exemplary embodiment and the other a high sub-band [Fhinf–Fhsup], i.e. [200 MHz–512 MHz]. The low sub-band is connected to the output 18 and the high sub-band is connected to the output 16.

What is claimed is:

1. A wideband antenna system capable of radiating or receiving radio-frequency signals in a given frequency band, comprising at least two substantially collinear radiating elements, wherein each element radiates in one frequency band, a first radiating element working in the [Fhinf, Fhsup] frequency band, a second radiating element working in the [Fminf, Fmsup] frequency band, and wherein, at the [hinge] frequencies, these two elements participate in the radiation, wherein, a third radiating element working in the frequency band [Fbinf, Fbsup], wherein, the radiating elements are connected to a power supply network comprising one input and three outputs respectively connected to the first, second, and third radiating elements by three transmission lines, and wherein, the power supply network comprises at least one bandwidth filter, one duplexer whose duplex gap corresponds to the band of the filter and one hybrid 3 dB power divider.

2. An antenna system according to claim 1, wherein the frequency Fmsup is greater than or equal to the frequency Fhinf.

3. An antenna system according to claim 1, wherein the frequency Fbsup is greater than or equal to the frequency Fminf, and the frequency Fmsup is greater than or equal to the frequency Fhinf.

4. An antenna system according to claim 1 wherein the lengths of the transmission lines are chosen so that the RF signals at the frequencies Fhinf to Fmsup feed the first and second radiating elements in phase and wherein the RF signals at the frequencies Fminf to Fbsup feed the second and third radiating elements in phase.

5. An antenna system according to claim 4 wherein, at the frequencies Fhinf to Fmsup, the first radiating element radiates in half-waves.

6. An antenna system according to claim 4 wherein, at the frequencies Fhinf to Fmsup, the second radiating element radiates in half-waves.

7. A system according to claim 4 wherein the second radiating element radiates in full waves for Fhinf to Fmsup and the third radiating element radiates in full waves for Fminf to Fbsup.

8. A system according to claim 1 wherein the first and second radiating elements are dipoles and the third radiating element is a monopole.

* * * * *